US006217353B1

(12) United States Patent
Yu-Tse

(10) Patent No.: US 6,217,353 B1
(45) Date of Patent: Apr. 17, 2001

(54) STRUCTURE OF A SAFETY RECEPTACLE

(75) Inventor: Lin Yu-Tse, Taipei (TW)

(73) Assignee: Aurise Inc., Yun Lin Hsien (TW)

( * ) Notice: Subject to any disclaimer, the term of this patent is extended or adjusted under 35 U.S.C. 154(b) by 0 days.

(21) Appl. No.: 09/451,713

(22) Filed: Dec. 1, 1999

(51) Int. Cl.[7] ..... H01R 13/44
(52) U.S. Cl. ..... 439/145; 174/67; 439/137
(58) Field of Search ..... 174/53, 66, 67; 200/51 R, 51.09; 220/3.8, 241, 242; 439/93, 113, 114, 136, 137, 138, 139, 140, 145

(56) References Cited

U.S. PATENT DOCUMENTS 2,477,803 * 8/1949 Huber ..... 174/67
4,148,536 * 4/1979 Petropoulsos et al. ..... 339/42
4,168,104 * 9/1979 Buschow ..... 439/145
4,271,337 * 6/1981 Barkas ..... 200/51.09
4,379,607 * 4/1983 Bowden, Jr. ..... 439/137
4,591,732 * 5/1986 Neuenschwander ..... 200/51 R
5,006,075 * 4/1991 Bowden, Jr. ..... 439/137
5,113,045 * 5/1992 Crofton ..... 200/51.09
5,518,132 * 5/1996 Chen ..... 220/3.8
5,727,958 * 3/1998 Chen ..... 174/67
5,998,735 * 12/1999 Patterson, Jr. ..... 174/67
6,056,564 * 5/2000 Huang ..... 439/145
6,086,391 * 6/2000 Chiu ..... 439/145

* cited by examiner

*Primary Examiner*—Kristine Kincaid
*Assistant Examiner*—Angel R. Estrada
(74) *Attorney, Agent, or Firm*—A & J

(57) ABSTRACT

A safety receptacle includes a casing having a top formed with two slots, a pair of rectangular slides arranged within the casing in opposite directions, each of the slides having three sides formed with a plurality of semi-circular projections and another side with a resilient member, each of the slides having a first opening formed with an inclined shoulder and a second opening formed with a flat shoulder, each of the slides further having at top formed with a plurality of protuberances and a bottom formed with a rib, and a bottom cover configured to engage with a bottom of the casing and having a supporting portion for supporting the slides, whereby the safety receptacle can be easily manufactured and assembled.

1 Claim, 5 Drawing Sheets

STRUCTURE OF A SAFETY RECEPTACLE

BACKGROUND OF THE INVENTION

1. Field of the Invention

This invention is related to an improvement in the structure of a safety receptacle and in particular to one which is simple in construction and easy to assemble.

2. Description of the Prior Art

Referring to FIG. 1, the conventional safety receptacle 1 generally includes a body portion, an upper slide 11, a lower slide 12 and two springs 13. The body portion is formed with two slots 14 at the top and a passage 10 in communication with the two slots 14. The upper slide 11 is first engaged with the lower slide 12 and then fitted into the passage 10. The two springs 13 are used for urging the upper slide 11 and the lower slide 12 to move in opposite directions to close the slots 14. However, it is very difficult to mount the springs 13 on the slides 11 and 12 in such a small space thereby lowering the efficiency in assembly and reducing the production rate. In addition, the slides 11 and 12 are of different structures which will increase the cost and difficulty in assembly.

Therefore, it is an object of the present invention to provide an improved receptacle which can obviate and mitigate the above-mentioned drawbacks.

SUMMARY OF THE INVENTION

This invention is related to an improvement in the structure of a safety receptacle.

According to a preferred embodiment of the present invention, a safety receptacle includes a casing having a top formed with two slots, a pair of rectangular slides arranged within the casing in opposite directions, each of the slides having three sides formed with a plurality of semi-circular projections and another side with a resilient member, each of the slides having a first opening formed with an inclined shoulder and a second opening formed with a flat shoulder, each of the slides further having at top formed with a plurality of protuberances and a bottom formed with a rib, and a bottom cover configured to engage with a bottom of the casing and having a supporting portion for supporting the slides.

It is the primary object of the present invention to provide an improvement in the structure of a safety receptacle which is simple in construction.

It is another object of the present invention to provide an improvement in the structure of a safety receptacle which is easy to assemble.

It is still another object of the present invention to provide an improvement in the structure of a safety receptacle which is low in cost.

It is still another object of the present invention to provide an improvement in the structure of a safety receptacle where insertion of an object will cause no damage to the person inserting it.

It is a further object of the present invention to provide an improvement in the structure of a safety receptacle which is fit for mass production.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
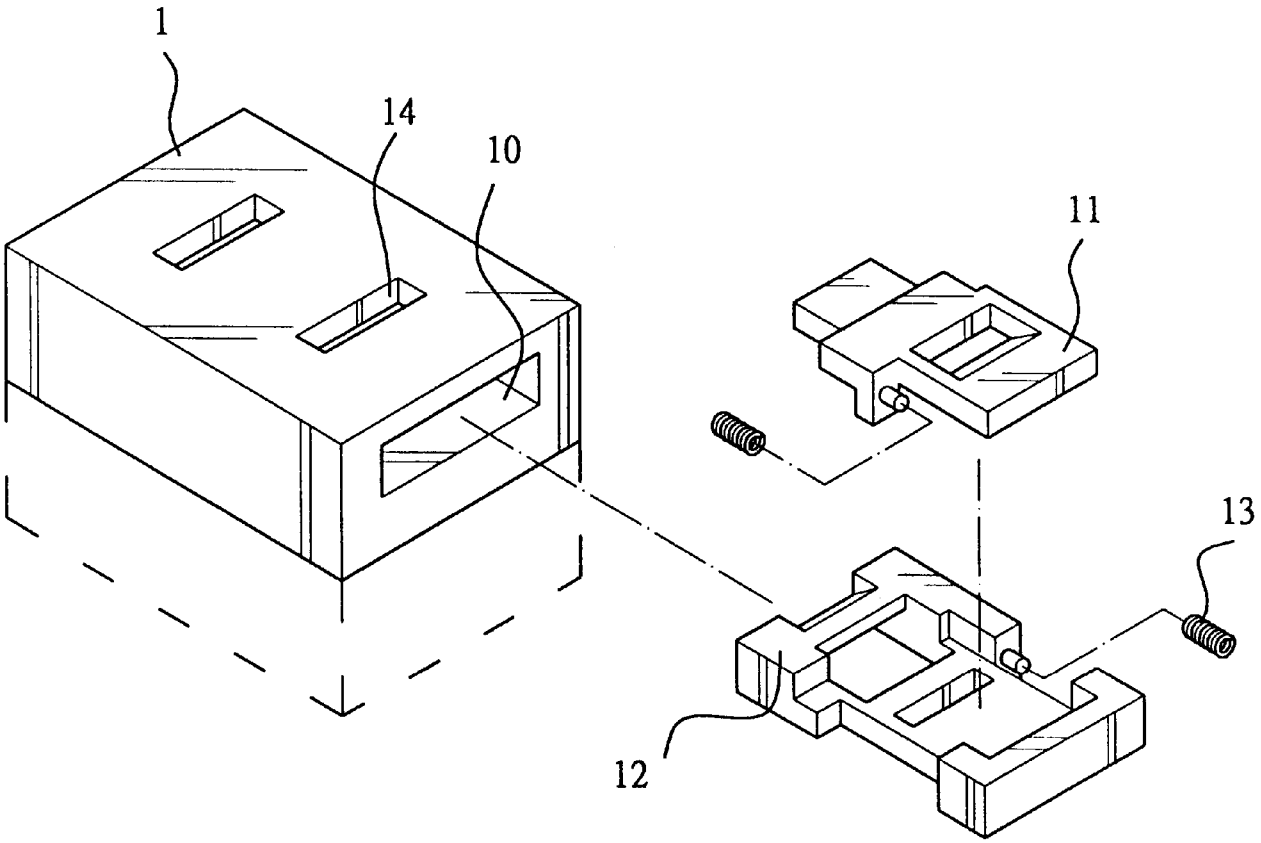
PRIOR ART FIG. 1
FIG. 1 is an exploded view of a prior art safety receptacle.
Figures 2, 2A, 2B:
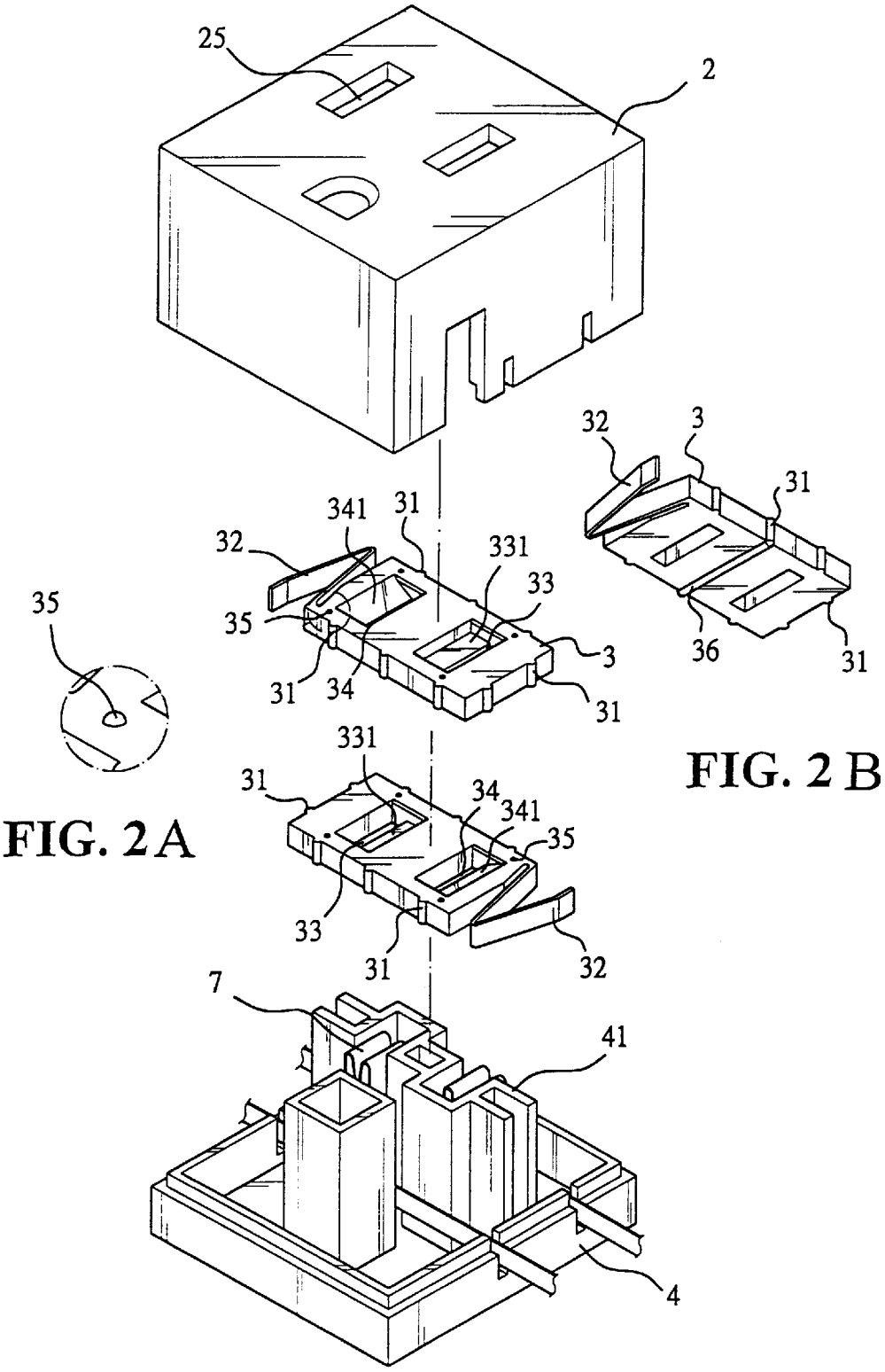
FIG. 2 is an exploded view of a safety receptacle according to the present invention.
FIG. 2A is an enlarged fragmentary view of FIG. 2.
FIG. 2B is a bottom perspective view of the slide.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 2, 2A, 2B and 3 thereof, the safety receptacle according to the present invention generally comprises a casing 2, a pair of slides 3 and a bottom cover 4. The casing 2 is formed with two slots 25 at the top and two vertical partitions 21 at the interior thereby forming a chamber (shown but not numbered). The slide 3 is a rectangular member formed with a plurality of semi-circular projections 31 at three sides and a resilient member 32 at the other side. The resilient member 32 is integrally formed with the slide 3. The body portion of the slide 3 is formed with a first opening 34 close to the resilient member 32 and a second opening 33 close to the opposite side. The first and second openings 34 and 33 are formed with an inclined shoulder 341 and a flat shoulder 331, respectively. The slide 3 is further formed with a plurality of protuberances 35 at the top and a rib 36 at the bottom. The bottom cover 4 is configured to engage with the bottom of the casing 2 and provided with a supporting portion 41 for supporting the slides 3. The supporting portion 41 has recesses for receiving electrical terminals which are well known to the art and have no need to be described here in detail.

Figure 4:
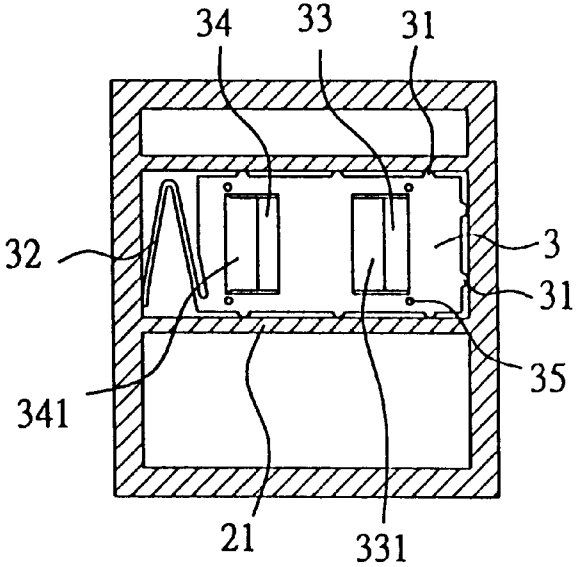
FIG. 4 is a sectional view illustrating how the slides are mounted within the casing.
Figure 3:
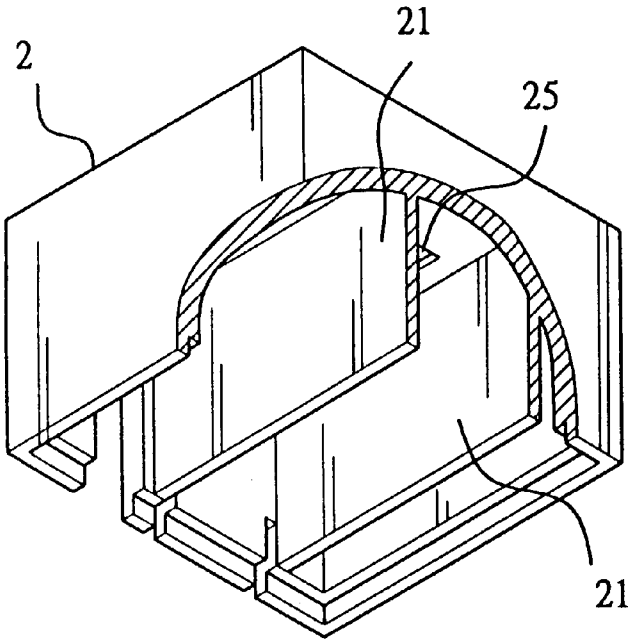
FIG. 3 is a cutaway view showing the structure of the casing.
Figure 6:
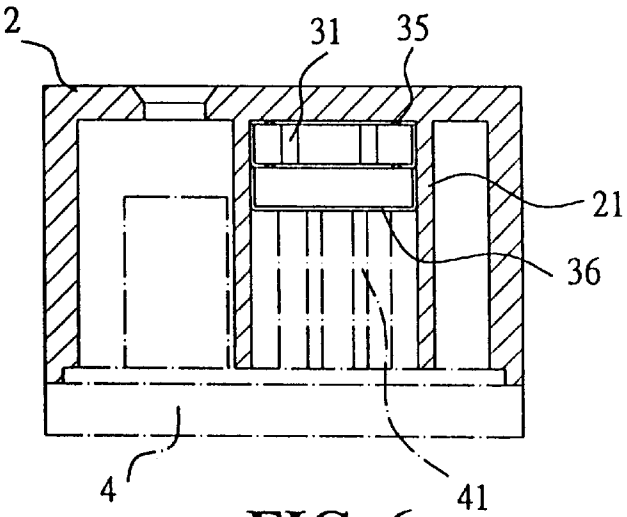
FIG. 6 is a sectional view illustrating the relative positions of the component parts of the present invention.
Figure 5:
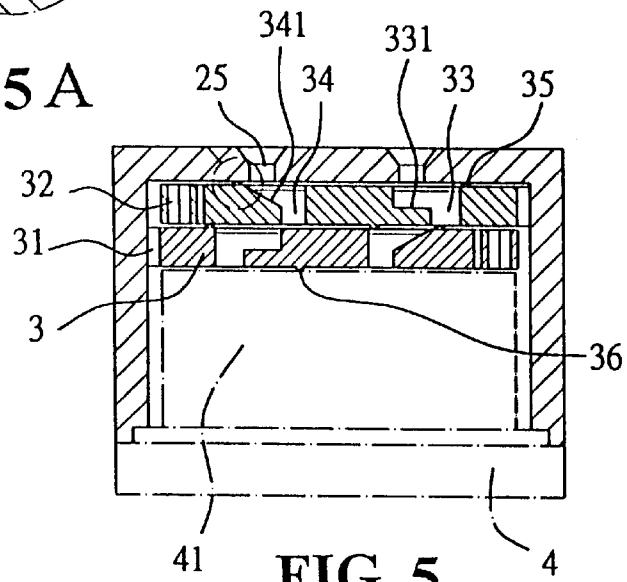
FIG. 5 is sectional view illustrating the relative positions of the component parts of the present invention.
Figure 5A:
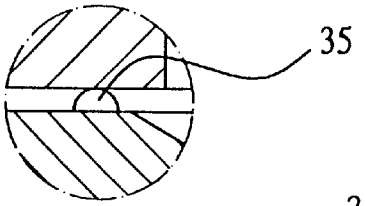
FIG. 5A is an enlarged fragmentary view of FIG. 5.

In assembly, the two slides 3 are arranged within the casing 2 in opposite directions so that the slides 3 are movably fitted within the chamber formed by the two partitions 21 of the casing 2 (see FIG. 4). The semi-circular projections 31 are used for reducing the friction between the slide 3 and the partitions 21. The rib 36 and the protuberance 35 are also used for reducing the friction produced when the slide 3 is moved (see FIGS. 5, 5A and 6). Then, electrical terminals 7 are mounted on the supporting portion 41 of the bottom cover 4. Finally, the bottom cover 4 is engaged with the bottom of the casing 2.

Figure 9:
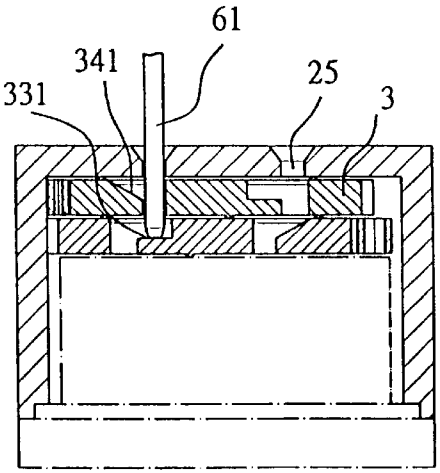
FIGS. 7, 8 and 9 illustrate the working principle of the present invention.
Figure 8:
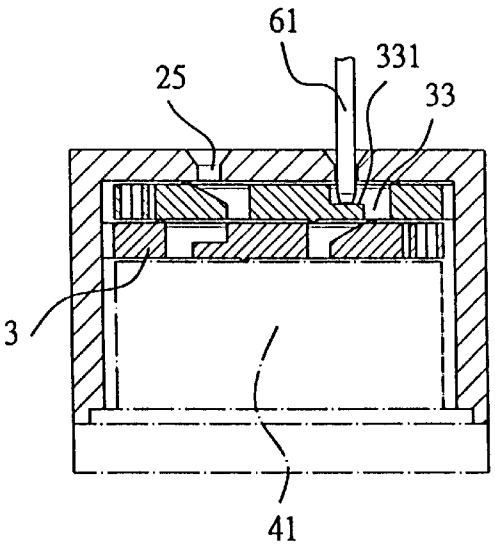
Figure 7:
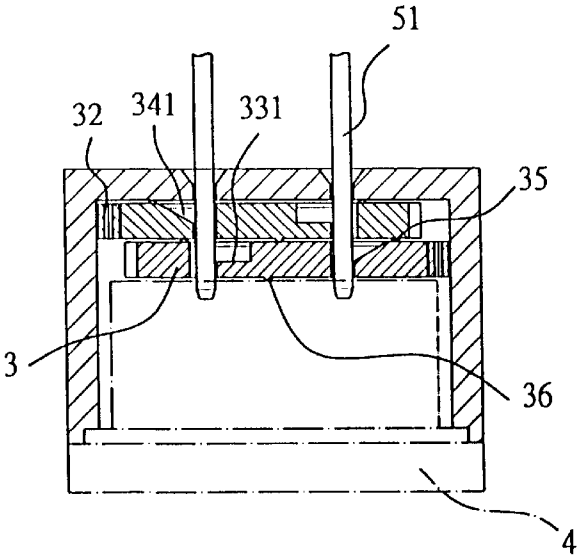

Referring to FIG. 7, when the blades 51 of an electrical plug (not shown) are inserted through the slots 25 of the casing 2 into the openings 33 and 34 of the slide 3, the blades 51 will push the upper slide 3 to move the left and the lower slide 3 to the right with respect to FIG. 7 thereby aligning the openings 34 and 33 of the upper and lower slides 3 and therefore enabling the blades 51 to be inserted through the openings 34 and 33 to engage with electrical terminals (not shown) mounted in the supporting portion 41 of the bottom cover 4. As the blades 51 of the electrical plug are pulled out of the casing 2, the resilient members 32 of the slides 3 will push the slides 3 to move in opposite directions thereby closing the openings 34 and 33. When a metal object 61 is inserted through the slot 25 at the left side (with respect to FIG. 8), the flat shoulder 331 of the opening 33 of the upper slide 3 will block the metal object 61 from passing through the opening 33 thereby causing no damage to the person inserting it (see FIG. 8). Likewise, when the metal object 61 is inserted through the slot 25 at the right side (with respect to FIG. 9) into the opening 34 of the upper slide 3, the flat shoulder 331 of the opening 33 of the lower slide 3 will block the metal object 61 from passing through the opening 33 thus keeping the person inserting it from danger.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safety receptacle comprising:

a casing having a top formed with two slots;

a pair of rectangular slides arranged within said casing in opposite directions, each of said slides having three sides formed with a plurality of semi-circular projections and another side with a resilient member, each of said slides having a first opening formed with an inclined shoulder and a second opening formed with a flat shoulder, each of said slides further having a top formed with a plurality of protuberances and a bottom formed with a rib; and a bottom cover configured to engage with a bottom of said casing and having a supporting portion for supporting said slides, said supporting portion having recesses for receiving electrical terminals.

* * * * *